US011752769B2

(12) United States Patent
Iwama et al.

(10) Patent No.: US 11,752,769 B2
(45) Date of Patent: Sep. 12, 2023

(54) HEAD BAR UNIT AND PRINTING APPARATUS INCLUDING HEAD BAR UNIT

(71) Applicant: BROTHER KOGYO KABUSHIKI KAISHA, Nagoya (JP)

(72) Inventors: Noritaka Iwama, Ichinomiya (JP); Yuya Tsuneoka, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/693,915

(22) Filed: Mar. 14, 2022

(65) Prior Publication Data

US 2022/0297427 A1 Sep. 22, 2022

(30) Foreign Application Priority Data

Mar. 16, 2021 (JP) ..... 2021-042395

(51) Int. Cl.
*B41J 2/145* (2006.01)
*B41J 29/38* (2006.01)
*B41J 11/20* (2006.01)

(52) U.S. Cl.
CPC ..... *B41J 2/145* (2013.01); *B41J 29/38* (2013.01); *B41J 2202/15* (2013.01); *B41J 2202/19* (2013.01)

(58) Field of Classification Search
CPC ... B41J 2/145; B41J 29/38; B41J 11/20; B41J 25/308
See application file for complete search history.

(56) References Cited

U.S. PATENT DOCUMENTS 6,786,658 B2 * 9/2004 Silverbrook ..... B41J 11/20 347/29
7,101,005 B2 * 9/2006 Buonerba ..... B41J 25/3088 400/59
2011/0199412 A1 * 8/2011 Nakayama ..... B41J 29/38 347/14
2013/0307893 A1 11/2013 Suda et al.
2017/0072722 A1 3/2017 Mueller et al.
2018/0170060 A1 6/2018 Campillo et al.

FOREIGN PATENT DOCUMENTS

JP 2013-240988 A 12/2013

OTHER PUBLICATIONS

Extended European Search Report issued in corresponding European Patent Application No. 22161767.3, dated Jul. 19, 2022.

* cited by examiner

*Primary Examiner* — Jason S Uhlenhake
(74) *Attorney, Agent, or Firm* — Merchant & Gould P.C.

(57) ABSTRACT

There is provided a head bar unit including a head bar, an adjuster and a movement. The head bar includes a plurality of heads. The adjuster is supported by the head bar, and is configured to adjust positions in a vertical direction of the heads. The movement is configured to move the head bar and the adjuster in the vertical direction. The adjuster includes a motor, a rotator and a stopper. The rotator includes a plurality of contact portions. The rotator is configured to be rotated by the motor around a rotating shaft. The stopper is located at a position facing the rotator in the vertical direction, and is configured to position the rotator in the vertical direction, by making contact with one of the contact portions.

16 Claims, 9 Drawing Sheets

HEAD BAR UNIT AND PRINTING APPARATUS INCLUDING HEAD BAR UNIT

CROSS REFERENCE TO RELATED APPLICATIONS

The present application claims priority from Japanese Patent Application No. 2021-042395, filed on Mar. 16, 2021, the disclosure of which is incorporated herein by reference in its entirety.

BACKGROUND

The present disclosure relates to a head bar unit which includes a mechanism which moves a head bar having a plurality of heads in a vertical direction, and a printing apparatus which includes the head bar unit.

A certain heretofore known printing apparatus includes a mechanism which moves vertically a head bar having a plurality of ink-jet heads by an air cylinder. In the heretofore known printing apparatus, it is possible to move the head bar downward substantially by driving the air cylinder. The heretofore known printing apparatus further includes a first engaging member which is extended downward below the head bar, as a mechanism which carries out a fine adjustment of a vertical position of the head bar after the head bar has moved downward, and a second engaging member which is extended upward below the head bar, and which is engaged with the first engaging member. The position in the vertical direction of the head bar is determined by the first engaging member and the second engaging member being engaged. Here, the first engaging member is provided at a front end of a male screw member screwed to a female screw member, and it is possible to move the first engaging member in the vertical direction by a motor rotating the male screw member. In such manner, by moving the first engaging member in the vertical direction by the motor, it is possible to adjust the vertical position of the head bar.

SUMMARY

Here, in the heretofore known printing apparatus, the first engaging member is moved in the vertical direction by rotating the male screw member by the motor. With the movement of the first engaging member, the head bar also moves in the vertical direction. Therefore, in a case in which a weight of the head bar is large (heavy), it was necessary to select a motor with a high output as the motor for rotating the male screw member. Since a cost of a drive system including such motor with a high output and a gear head to be connected to the motor with a high output becomes extremely high, it was becoming a factor contributing to a high cost of the printing apparatus.

An object of the present disclosure is to provide a technology which enables to adjust the vertical position of the head bar, without using a motor with a high output.

According to an aspect of the present disclosure, there is provided a head bar unit including a head bar, an adjuster and a movement. The head bar includes a plurality of heads. The adjuster is configured to adjust positions in a vertical direction of the plurality of heads. The movement is configured to move the head bar and the adjuster in the vertical direction. The adjuster includes a motor, a rotator and a stopper. The rotator includes a plurality of contact portions. Positions of the contact portions in the vertical direction are different from each other. The rotator is configured to be rotated by the motor around a rotating shaft which is parallel to the vertical direction. The stopper is located at a position facing the rotator in the vertical direction, and is configured to position the rotator in the vertical direction, by making contact with one of the contact portions.

In the abovementioned configuration, the motor in the adjuster being used for rotating the rotator, is not required to be a motor with a high output which is necessary for moving the head bar up and down for example. In the abovementioned configuration, since it is possible to use an air cylinder for instance, as the movement which moves the head bar up and down, it is possible to reduce a cost as compared to that in a case of moving the head bar up and down by using a motor. Moreover, the plurality of contact portions on the rotator to be rotated by the motor are at mutually different positions in the vertical direction. By selecting any of the contact portions to make a contact with the stopper, it is possible to adjust easily the position of the head bar in the vertical direction.

DETAILED DESCRIPTION

Figure 1:
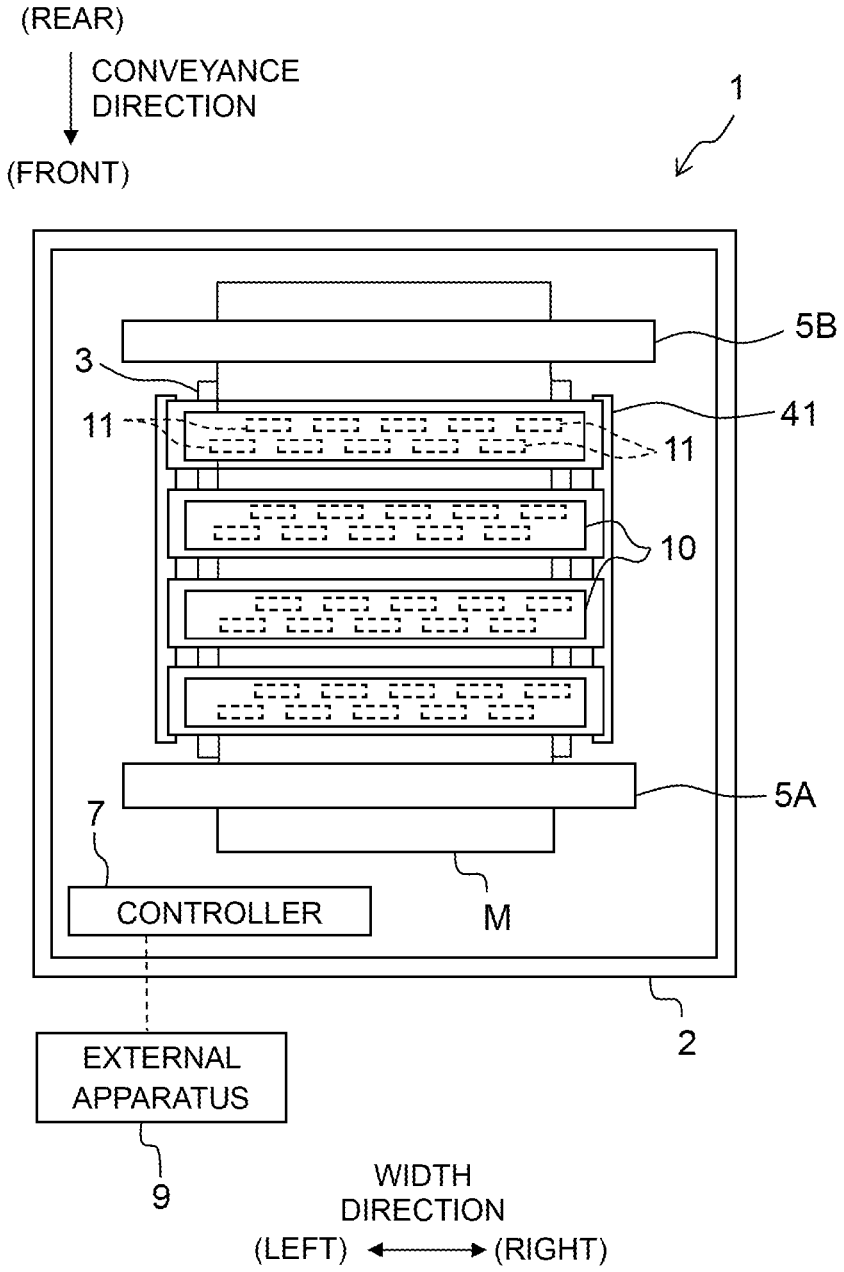
FIG. 1 is a plan view depicting schematically a printing apparatus 1.

A printing apparatus 1 according to an embodiment of the present disclosure will be described below with reference to the accompanying diagrams. FIG. 1 is a plan view depicting schematically the printing apparatus 1. In FIG. 1, a conveyance direction of a recording medium M corresponds to a frontward-rearward direction of the printing apparatus 1. Moreover, a direction of width of the recording medium M corresponds to a left-right direction of the printing apparatus 1. Furthermore, a direction orthogonal to the frontward-rearward direction and the left-right direction, or in other words, a direction perpendicular to a paper surface in FIG. 1 corresponds to a vertical direction of the printing apparatus 1.

As depicted in FIG. 1, the printing apparatus 1 includes a platen 3, four heads 10, two conveyance rollers 5A and 5B, and a controller 7 accommodated inside a casing 2. Moreover, although it is not depicted in FIG. 1, the printing apparatus 1 includes a maintenance unit 20 (refer to FIG. 3), a movement 50 (refer to FIG. 5), and an adjuster 60 (refer to FIG. 5) that will be described later. In the present specification, at least one head bar 10, the movement 50, and the adjuster 60 are collectively called as a head bar unit. Moreover, the head bar unit and the maintenance unit 20 are collectively called as a head bar system.

As depicted in FIG. 1, the recording medium M is to be placed on an upper surface of the platen 3. The four head bars 10 are arranged above the platen 3, to be facing the platen 3. An ink of a different color is supplied to each head bar 10 from an ink tank 3 (refer to FIG. 3). A structure of the head bar 10 will be described later in detail.

As depicted in FIG. 1, the two conveyance rollers 5A and 5A are arranged at a front side and a rear side respectively. Each of the two conveyance rollers 5A and 5B is driven by a motor which is not depicted in the diagram, and the recording medium M on the platen 3 is transported to a downstream side (front side) of the conveyance direction.

The controller 7 includes an FPGA (Field Programmable Gate Array), an EEPROM (Electrically Erasable Programmable Read-only Memory), and a RAM (Random Access Memory). The controller 7 may also include a CPU (Central Processing Unit) or an ASIC (Application Specific Integrated Circuit). The controller 7 is data-communicably connected to an external apparatus 9 such as a PC (Personal Computer), and controls each section of the printing apparatus 1 on the basis of print data that has been sent from the external apparatus 9.

Figure 2:
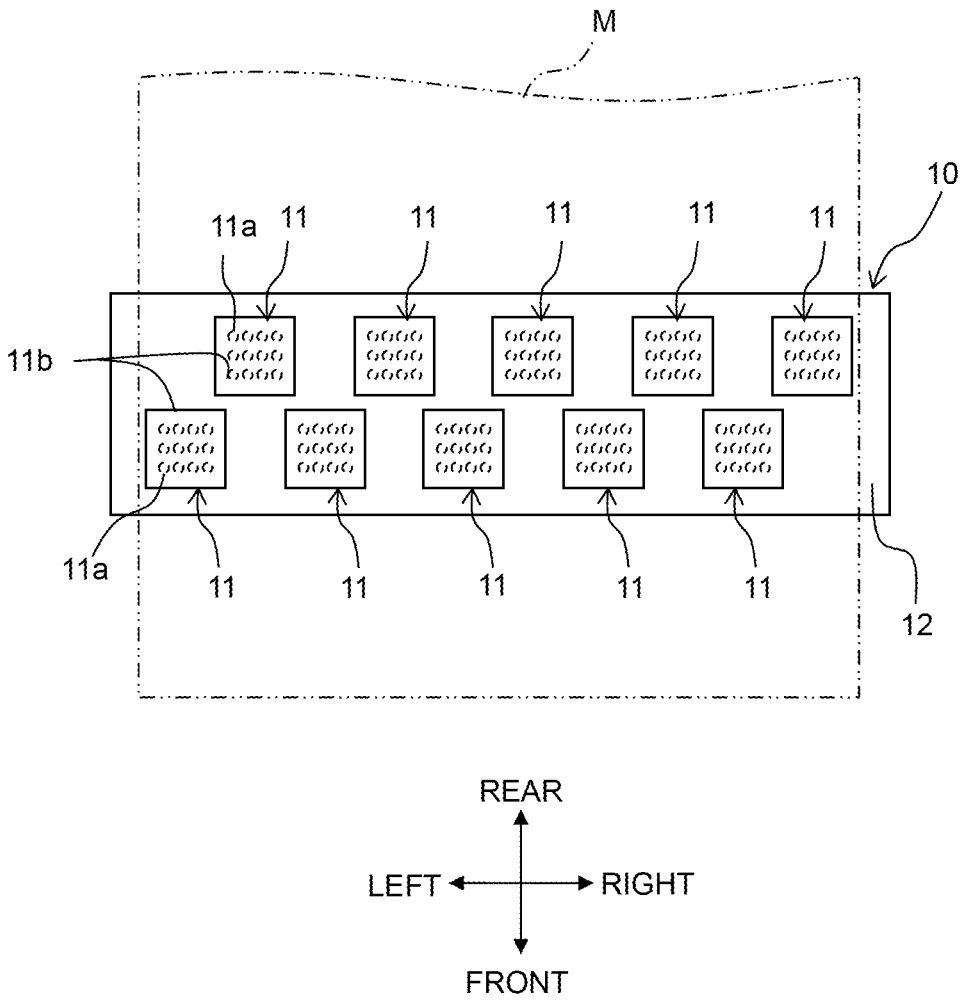
FIG. 2 is a plan view depicting schematically a head bar 10.
Figure 3:
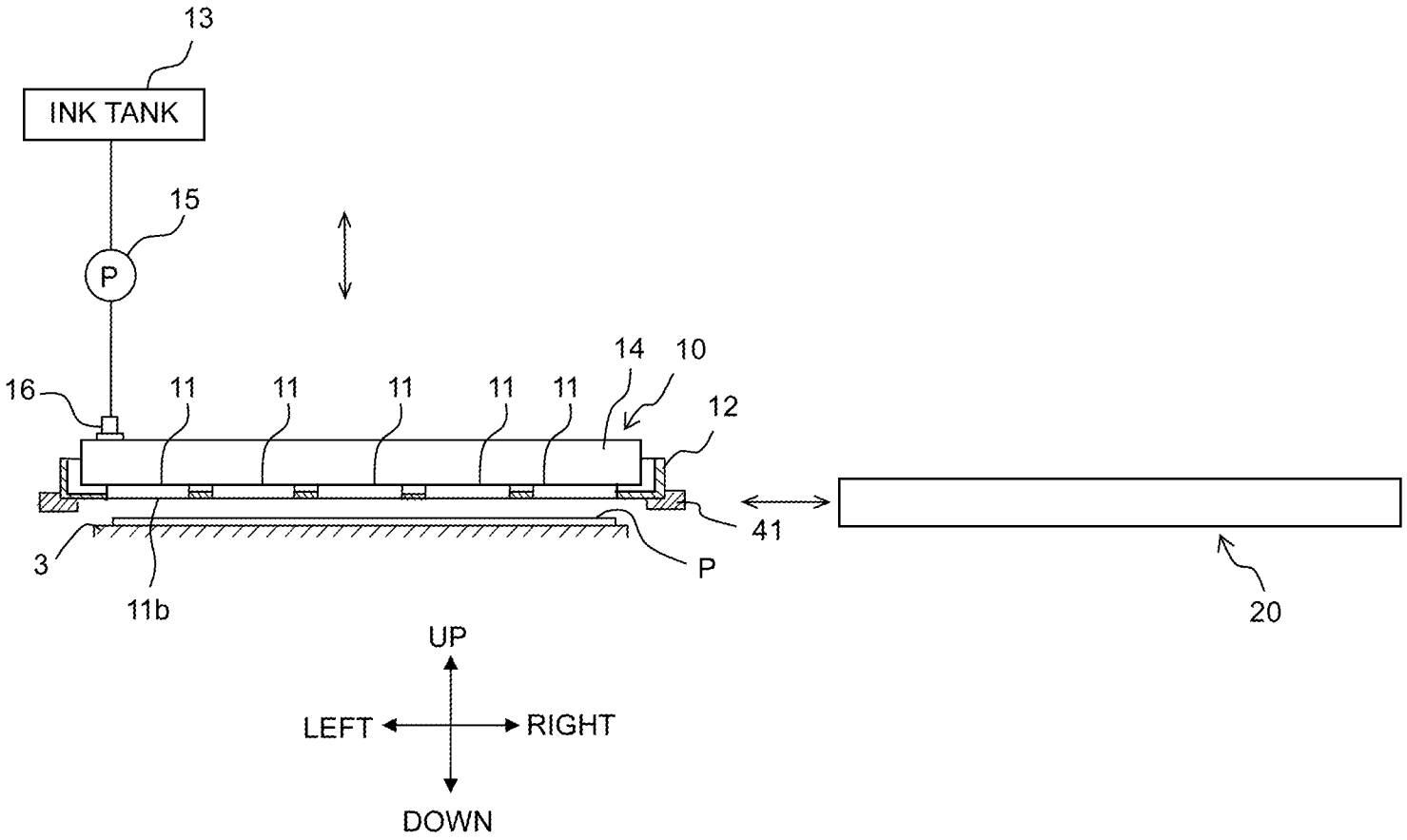
FIG. 3 is a schematic diagram for describing the head bar 10 and a maintenance unit 20.

FIG. 2 is a plan view depicting one of the four head bars 10 in a simplified manner. FIG. 3 is a simplified cross-sectional view of the printing apparatus 1. As depicted in FIG. 2, the head bar 10 includes a plurality of heads 11 (10 heads 11 in the present embodiment), and a holder bar 12 which holds the plurality of heads 11. The holder bar 12 has a shape of a rectangular plate which is long in the left-right direction. The plurality of heads 11 form two head rows arranged side-by-side in the frontward-rearward direction. Five heads 11 arranged side-by-side in the left-right direction are included in each head row. Positions of the heads 11 in the two head rows are misaligned in the left-right direction. In other words, the 10 heads 11 are arranged in a zigzag form.

A lower surface 11*b* of each head 11 is a nozzle surface in which a plurality of nozzles 11*a* is formed. As depicted in FIG. 2, the plurality of nozzles 11*a* of the head 11 are arranged side-by-side in a row along the left-right direction which is a longitudinal direction of the head bar 10 (holder bar 12).

As depicted in FIG. 3, a reservoir 14 is arranged at an upper side (above) the plurality of heads 11. The reservoir 14 is connected to the ink tank 13 via a tube 16. A booster pump 15 is provided to the tube 16. In the reservoir 14, an ink supplied from the ink tank 13 is accumulated temporarily. A lower portion of the reservoir 14 is connected to the plurality of heads. The ink is supplied to the plurality of heads 11 from the reservoir 14.

The controller 7 controls the motors driving the conveyance rollers 5A and 5B, and transports the recording medium M to the two conveyance rollers 5A and 5B. Moreover, herewith, the controller 7 controls the four head bars 10, and makes jet the ink from the nozzles 11*a* toward the recording medium M. Accordingly, an image is printed on the recording medium M.

As depicted by an arrow in FIG. 3, the head bar 10 is movable in the vertical direction by the movement 50 that will be described later. The maintenance unit 20 is arranged on a right side of the head bar 10. The maintenance unit 20 is movable in the left-right direction, and is movable between a right position and a left position. The right position is a position distant (away) from the head bar 10 to a right side, and is a position not facing the head bar 10. The left position is a position on a lower side of the head bar 10, and is a position facing the head bar 10. The maintenance unit 20 moves to left and to right by a ball screw mechanism for example.

Figure 4:
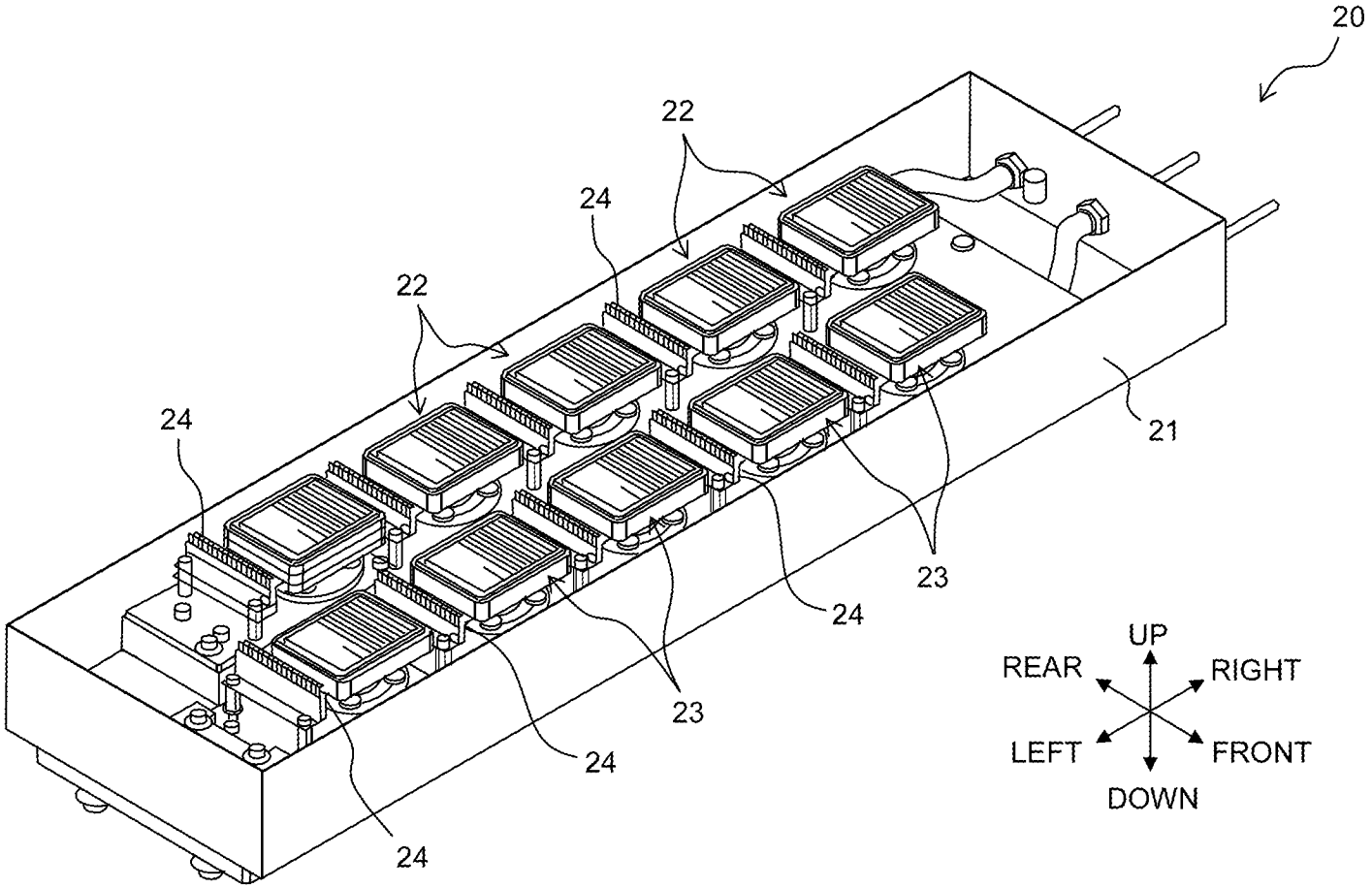
FIG. 4 is a perspective view of the maintenance unit 20.

FIG. 4 is a perspective view depicting the maintenance unit 20. The maintenance unit 20 includes a waste liquid pan 21, and a plurality of suction units 22 (10 suction units 22 in the present embodiment) arranged at an interior of the waste liquid pan 21. The waste liquid pan 21 has a rectangular box shape, and an upper surface thereof is open. The 10 suction units 22 correspond to the heads 11, and are arranged in a zigzag shape. When the maintenance unit 20 is at the left position, the suction units 22 are facing the heads 22 in the vertical direction. Each suction unit 22 has a cap 23. The cap 23 is formed of a flexible material such as rubber. The cap 23 has a rectangular box shape of which an upper surface is open. The 10 caps 23 are connected to a suction pump and a waste liquid tank not depicted in the diagram. By lowering the head bar 10 up to a predetermined position by the movement 50 that will be described later, in a state of the suction units 22 facing the heads 11 in the vertical direction, the caps 23 make a contact with the heads 11 to cover the nozzles 11*a* of the head 11.

By driving the suction pump which is not depicted in the diagram, in a state of the caps 23 making a contact with the lower surface 11*b* of the heads 11 to cover the plurality of nozzles 11*a*, it is possible to depressurize a space between the caps 23 and the lower surface 11*b* of the heads 11. Accordingly, it is possible to carry out a suction purge which is (a process of) sucking and discharging an ink from (through) each of the plurality of nozzles 11. By carrying out the suction purge, it is possible to discharge forcibly from the nozzles 11*a* a highly thickened ink inside the nozzles 11*a*, and to recover jetting characteristics of the heads 11. The ink discharged by the suction purge is accumulated in the waste liquid tank which is not depicted in the diagram.

As depicted in FIG. 4, a wiper 24 is provided, each between the two suction units 22 arranged side-by-side in the left-right direction, and on a left side of the suction unit 22 on an extreme left side. The wiper 24 is formed of an elastic material such as rubber and fabric. The wiper 24 wipes a nozzle surface by sliding on the nozzle surface in which the nozzles 11*a* of the heads 11 are formed.

Next, a structure of the head bar unit will be described in detail while referring to FIG. 5 and FIG. 6. As mentioned above, the head bar unit has at least one head bar 10, the movement 50, and the adjuster 60. The head bar unit further includes a pair of arms 41, a first frame 42, a second frame 43, and two shafts 44. The pair of arms 41 supports at least one of the four head bars 10. The first frame 42 is a member in a form of a plate and has the pair of arms 41 attached thereto. The second frame 43 is located beneath the first frame 42. The two shafts 44 are extended upward from two end portions in the left-right direction of the second frame 43. For simplifying the diagram, in FIG. 5, the head bar 10 and the arms 41 are omitted.

Of the pair of arms 41, a first arm 41 is fixed to one end portion in the left-right direction of the first frame 42, and a second arm 42 is fixed to the other end portion in the left-right direction of the first frame 42. As depicted in FIG. 6, each of the pair of arms 41 has a first arm portion 41*a* extended in the frontward-rearward direction, an inclined portion 41*b* extended upward from a front-end portion of the first arm portion 41*a*, and a second arm portion 41*c* extended frontward from an upper end of the inclined portion 41*b*. A front end of the second arm portion 41*c* is fixed to the first frame 42. The pair of arms 41 being fixed to two end portions in the left-right direction of the first frame 42, the first arm portions 41*a* of the two arms 41 are face-to-face leaving a space in the left-right direction. The head bar 10, in a state of being spanned over between the first arm portions 41*a* of the two arms 41, is fixed to each of the first arm portions 41*a* of the two arms 41.

Of the two shafts 44, a lower end of a first shaft 44 is fixed to one end portion in the left-right direction of the second frame 43, and a lower end of a second shaft 44 is fixed to the other end portion in the left-right direction of the second frame 43. Each shaft 44 passes through a through hole which is not depicted in the diagram, but is made in the first frame 42, and is extended further upward. At the time of moving the first frame 42 upward by the movement 50 that will be described later, the first frame 42 moves upward along the two shafts 44. In other words, the two shafts 44 function as a guide at the time of the first frame 42 moving upward.

Figure 5:
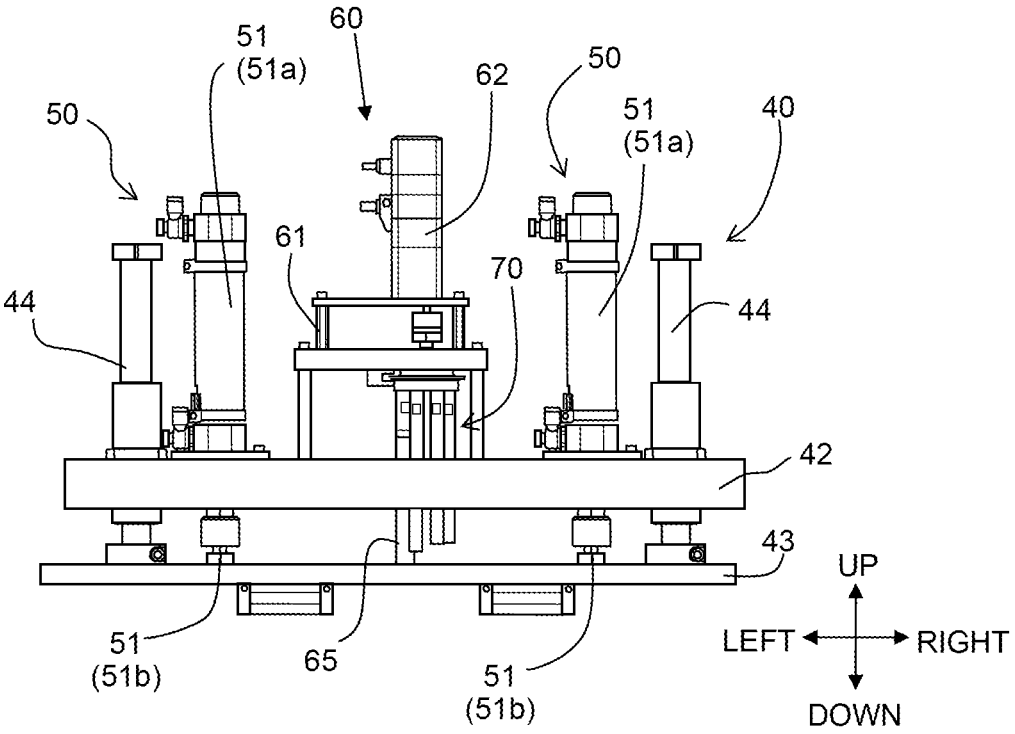
FIG. 5 is an illustration diagram depicting a state in which the head bar 10 is descended.
Figure 6:
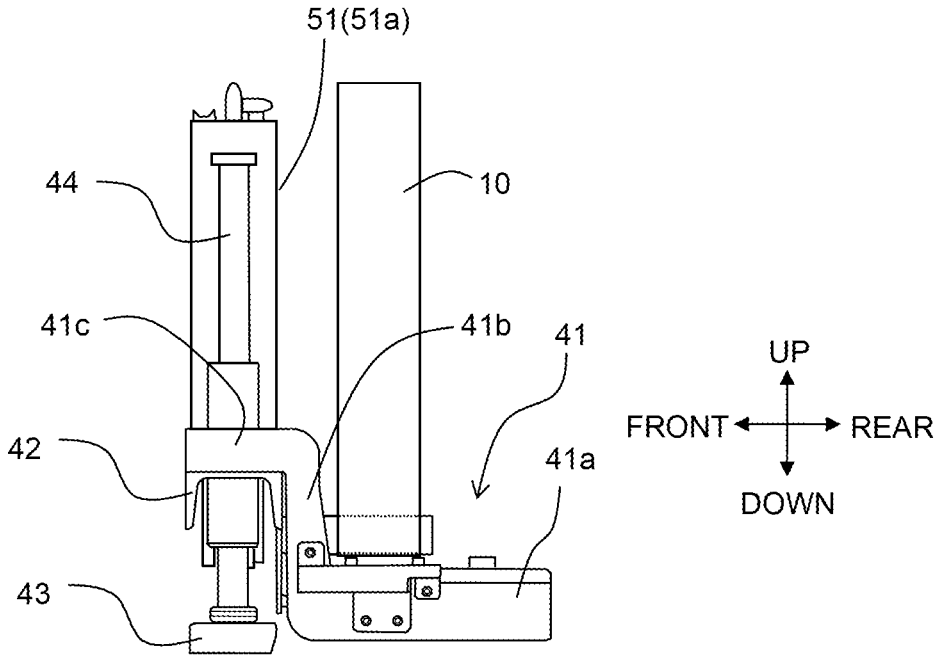
FIG. 6 is an illustration diagram depicting a state of the head bar 10 viewed from a side.

As depicted in FIG. 5, the first frame 42 is provided with the movement 50 and the adjuster 60. The movement 50 moves the head bar 10 in the vertical direction. The adjuster 60 adjusts a position in the vertical direction of the head bar 10 that has been moved in the vertical direction by the movement 50. The movement 50 includes a pair of air cylinders 51 and an air supply system not depicted in the diagram, which supplies air to the air cylinders 51. The pair of air cylinders 51 is arranged at equidistant positions away from the adjuster 60, between the two shafts 44 and in the left-right direction. Note that, the adjuster 60 is arranged almost in the middle of the head bar 10, in the left-right direction. Each of the pair of air cylinders 51 has a main body 51*a* in the form of a cylinder and a rod 51*b* which protrudes downward from the main body 51*a* by an air pressure. Each of the pair of main bodies 51 is fixed to the first frame 42, and each of front ends of the pair of rods 51*b* is fixed to the second frame 43. When the air cylinder 51 is driven such that the rod 51*b* protrudes from the main body 51*a* due to a reactive force thereof, the pair of main bodies 51*b* and the first frame 42 to which the pair of main bodies 51*b* is fixed move upward along the pair of shafts 44 (refer to FIG. 7). The pair of arms 41 is fixed to the first frame 42, and the head bar 10 is fixed to the pair of arms 41. Therefore, by the first frame 42 moving upward along the pair of shafts 44, the head bar 10 also moves upward. Conversely, at the time of driving the air cylinder 51 such that the rod 51*b* enters into the main body 51*a*, the first frame 42 moves downward along the pair of shafts 44. Accordingly, it is possible to move the head bar 10 downward.

The adjuster 60 includes a trestle (mount, stand) 61 which is fixed to the first frame 42, a motor 62, a rotator 70 which is attached to a rotating shaft of the motor 62, and a stopper 65 which is fixed to the second frame 43. A lower end of the trestle 61 is fixed to the first frame 42, and the motor 62 is fixed to an upper portion of the trestle 61. The rotator 70 is attached to the rotating shaft of the motor 62 via a coupling. A through hole which is not depicted in the diagram is formed in the first frame 42, and the rotator 70 passes through the through hole and is extended downward of the first frame 42. By driving the motor 62, it is possible to rotate the rotator 70 around the rotating shaft of the motor 62.

Figure 8A:
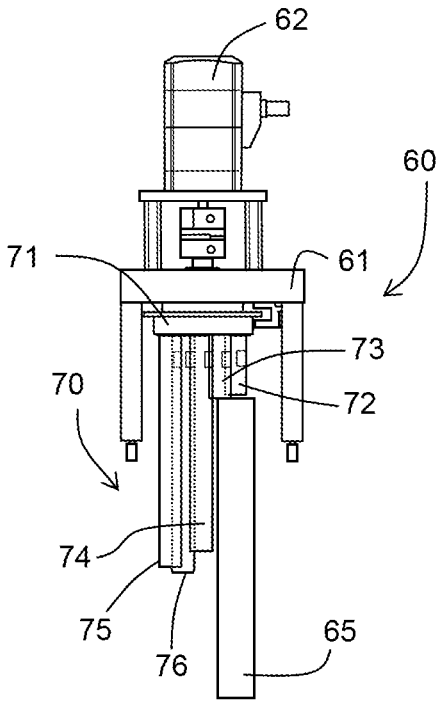
FIG. 8A is an illustration diagram depicting a state of an adjuster 60 viewed from a side.
Figure 8B:
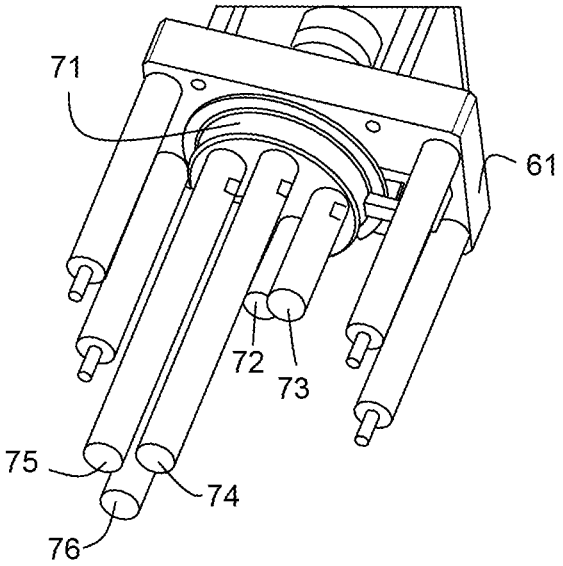
FIG. 8B is a perspective view for describing a rotator 70.

As depicted in FIG. 8A and FIG. 8B, the rotator 70 includes a base 71 which has a circular cylindrical shape, and five rods 72, 73, 74, 75, and 76 (hereinafter, 'rods 72 to 76') provided to a lower surface of the base 71. The five rods 72 to 76 are members having a circular cylindrical shape and different lengths mutually, and becoming longer in order from 72 to 76. The rods 72 to 76 are arranged side-by-side in a peripheral direction in this order on the lower surface of the base 71.

Figure 7:
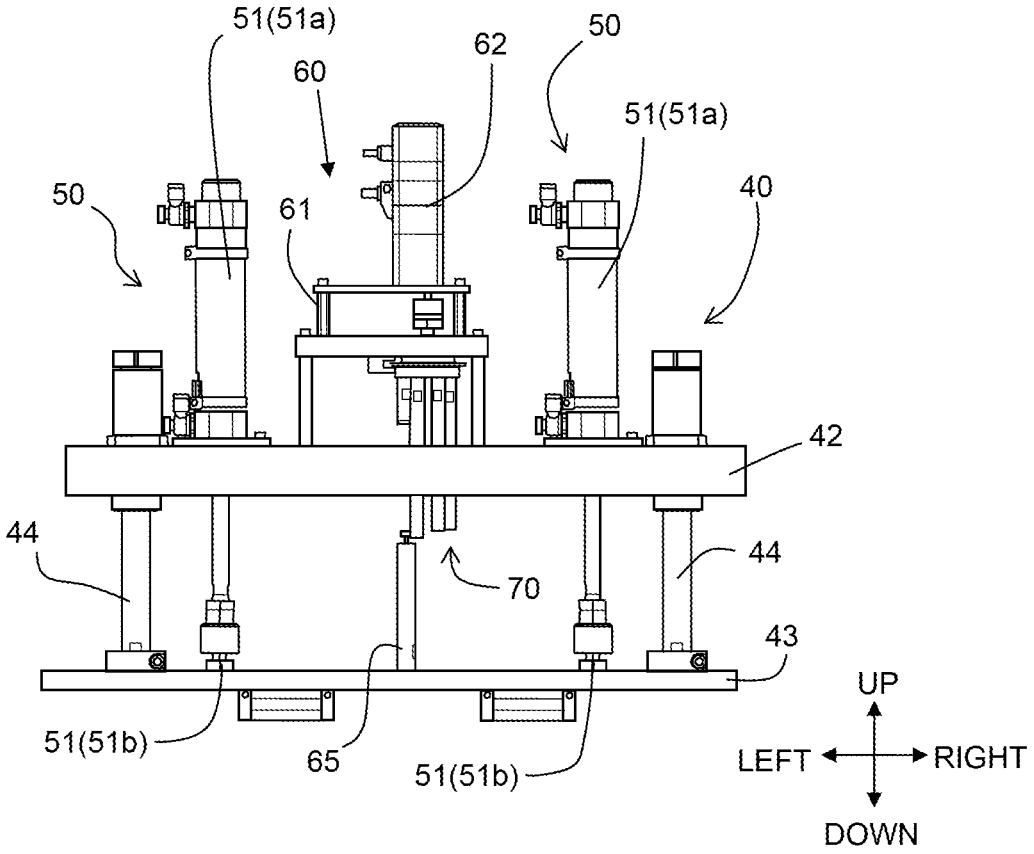
FIG. 7 is an illustration diagram depicting a state in which the head bar 10 is ascended.

As depicted in FIG. 5 and FIG. 7, a lower end of the stopper 65 is fixed to the second frame 43. The stopper 65 is arranged at a position facing the rotator 70 in the vertical direction. By rotating the rotator 70 around the rotating shaft of the motor 62 by driving the motor 62, it is possible to bring any one of the rods 72 to 76 face-to-face with the stopper 65. As it will be described later, by driving the air cylinder 51, the rotator 70 is moved such that any one of the rods 72 to 76 is facing the stopper 65, in a state of the first frame 42 moved to be at the uppermost position along the shaft 44. Thereafter, by driving the air cylinder 51, the first frame d42 is moved downward along the shaft 44 such that one of the rods 72 to 76 and the stopper 65 make a contact. Accordingly, it is possible to determine accurately a position in the vertical direction of the first frame 42, or in other words, to determine accurately a position in the vertical direction of the head bar 10. Note that, in the present embodiment, the rods 72 to 76 are formed of stainless steel, and the stopper 65 is formed of hardened stainless steel. Therefore, a hardness of the stopper 65 is higher than a hardness of the rods 72 to 76.

In the present embodiment, a lower end of the rod 72 is at a position $X_2$ mm away downward from the lower surface of the base 71 of the rotator 70. In the description below, a height-wise position of the lower end of the rod 72 is described to be $X_2$ mm. In a case in which, the lower end of the rod 72 has made a contact with a surface of the stopper 65, the head bar 10 is positioned to be (at the) lowermost (position). In the description below, the lower end of the rod 72 is referred to as a contact portion of the rod 72. The same applies to the other rods as well. In the description below, a position in the vertical direction of the head bar 10 in a case in which the rod 72 and the stopper 65 are in contact, is referred to as a first print position. In a case in which, the recording medium M is a thin sheet such as a regular paper, the head bar 10 is positioned at the first print position at the time of printing on the recording medium M.

In the present embodiment, a height-wise position of a contact portion of the rod 73 is $X_3$ mm. In a case in which the contact portion of the rod 73 has made a contact with the stopper 65, a space (gap) between the lower surface (nozzle surface) of the head bar 10 and the upper surface of the platen 3 becomes $X_3-X_2$ mm larger than a space between the upper surface of the platen 3 and the lower surface of the head bar 10 when the head bar 10 is at the first print position. In the description below, a position in the vertical direction of the head bar 10 in a case in which the contact portion of the rod 73 and the stopper 65 are in contact, is referred to as a second print position. At the time of printing on the recording paper M, in a case in which the recording paper M is a sheet thicker than the regular paper, the head bar 10 is positioned at the second print position. Consequently, the height-wise position of the contact portion of the rod 73 is larger (higher) than the height-wise position of the contact portion of the rod 72 ($X_3>X_2$), and $X_3-X_2$ corresponds to (a thickness of a thick sheet)−(a thickness of a thin sheet).

In the present embodiment, a height-wise position of a contact portion of the rod 74 is $X_4$ mm. In a case in which the contact portion of the rod 74 has made a contact with the stopper 65, a space (gap) between the lower surface of the head bar 10 and the upper surface of the platen 3 becomes approximately $2.5X_2(=X_4-X_2)$ mm larger than a space between the lower surface of the head bar 10 and the upper surface of the platen 3 when the head bar 10 is at the first print position. In the description below, a position in the vertical direction of the head bar 10 in a case in which the contact portion of the rod 74 and the stopper 65 are in contact is referred to as a capping position. When the head bar 10 is at the capping position, a front end of the cap 23 makes a contact with the lower surface of the head bar 10. A height (length in the vertical direction) of the cap 23 when the front end of the cap 23 is in contact with the lower surface (nozzle surface) of the head bar 10 is approximately $2.5X_2$ mm. Accordingly, it is possible to cap the lower surface of the head bar 10 by using the cap 23, thereby preventing drying of ink inside the nozzle 11*a* of the head 11, and it is possible to prevent a foreign matter from getting mixed inside the nozzle 11.

In the present embodiment, a height-wise position of a contact portion of the rod 75 is $X_5$ mm. In a case in which, the contact portion of the rod 75 has made a contact with the stopper 65, a space (gap) between the lower surface of the head bar 10 and the upper surface of the platen 3 becomes approximately $2.6X_2(=X_5-X_2)$ mm larger than a space between the lower surface of the head bar 10 and the upper surface of the platen 3 when the head bar 10 is at the first print position. In the description below, a position in the vertical direction of the head bar 10 in a case in which the contact portion of the rod 75 and the stopper 65 are in contact is referred to as a wiping position. When the head bar 10 is at the wiping position, a front end of the wiper 24 makes a contact with the lower surface of the head bar 10. A height (length in the vertical direction) of the wiper 24 when the front end of the wiper 24 is in contact with the lower surface (nozzle surface) of the head bar 10 is approximately $2.6X_2$ mm. By moving the maintenance unit 20 in the left-right direction in this state, it is possible to wipe off the nozzle surface of the head by 10 by the wiper 24. Note that, the height-wise position of the contact portion of the rod 75 is larger (higher) than the height-wise position of the contact portion of the rod 74 ($X_5>X_4$). Moreover, a height-wise position of a front end of the wiper 24 when the front end of the wiper 24 is in contact with the nozzle surface of the head bar 10 is larger (higher) than a height-wise position of an upper end of the cap 23 when the front end of the cap 23 is in contact with the nozzle surface of the head bar 10. In other words, $X_5-X_4$ substantially corresponds to (is substantially equivalent) to a value obtained by deducting the height-wise position of the upper end of the cap 23 when the front end of the cap 23 is in contact with the nozzle surface of the head bar 10 from the height-wise position of the front end of the wiper 24 when the front end of the wiper 24 is in contact with the nozzle surface of the head bar 10.

In the present embodiment, a height-wise position of a contact portion of the rod 76 is $X_6$ mm. In a case in which the contact portion of the rod 76 has made a contact with the stopper 65, a space (gap) between the lower surface of the head bar 10 and the upper surface of the platen 3 becomes approximately $3X_2(=X_6-X_2)$ mm larger than the space between the lower surface of the head bar 10 and the upper surface of the platen 3 when the head bar 10 is at the first print position. In the description below, a position in the vertical direction of the head bar 10 in a case in which the contact portion of the rod 75 and the stopper 65 are in contact, is referred to as a retracted position. When the head bar 10 is at the retracted position, since a space between the lower surface of the head bar 10 and the upper surface of the platen 3 become adequately large, at the time of moving the maintenance unit 20 in the left-right direction toward the lower side of the head bar 10, the head bar 10 and the maintenance unit 20 do not interfere mutually. By positioning the head bar 10 at the retracted position, it is possible to move the maintenance unit 20 in the left-right direction up to a position facing the head bar 10 in the vertical direction without interfering with the head bar 10. The height-wise position of the contact portion of the rod 76 is larger (higher) than the height-wise position of the contact portion of the rod 75 ($X_6>X_5$). Moreover, a height-wise position of the front end of the wiper 24 in a state of the front end of the wiper 24 not in a contact with the nozzle surface of the head bar 10 is larger (higher) than a height-wise position of the upper end of the wiper 24 in a state of the front end of the wiper 24 in contact with the nozzle surface of the head bar 10. In other words, $X_6-X_5$ corresponds to (is equivalent to) a value obtained by adding a slight value (amount) of a vertical play which is developed when the maintenance unit 20 moves, to a value obtained by deducting the height-wise position of the upper end of the wiper 24 when the front end of the wiper 24 is in contact with the nozzle surface of the head bar 10 from the height-wise position of the front end of the wiper 24 in a state of the front end of the wiper 24 not in contact with the nozzle surface of the head bar 10.

Next, a method of adjusting a position in the vertical direction of the head bar 10 using the adjuster 60 will be described below. Firstly, an origin adjustment of a motor which is to be carried out in an initial state such as after putting ON an electric power supply of the printing apparatus 1 will be described below. At the time of carrying out the origin adjustment of a motor, the controller 7, by driving the air cylinder 51, moves the first frame 42 upward such that the first frame 42 is farthest away from the second frame 43. Accordingly, the head bar 10 also moves upward to be farthest away from the platen 3. At this time, the front ends (contact portions) of the rods 72 to 76 do not make a mutual contact with the upper surface of the stopper 65, and have a space (gap) in the vertical direction. Consequently, at the time of rotating the rotator 70 by using the motor 62, a load applied to the motor 62 is extremely small. Note that, in the abovementioned heretofore known printing apparatus, the first engaging member coupled with the head bar was moved in the vertical direction by the male screw member being rotated by the motor. In such manner, in a case of a motor moving a large-weight (heavy) head bar, the load applied to the motor becomes large. Whereas, in the present embodiment, the motor 62 does not move the head bar 10, but rotates the rotator 70. Therefore, it is possible to reduce the load applied to the motor 62 as compared to the load applied to the motor of the abovementioned heretofore known printing apparatus. Next, the rotator 70 is rotated by driving the motor 62 such that, the rod 76 is facing the stopper 65 in the vertical direction. In the present embodiment, the position at which the rod 76 and the stopper 65 are facing (face-to-face) in the vertical direction becomes a control origin (origin of control) in (for) control of the motor 62 which rotates the rotator 70. In this state, by moving the first frame 42 downward by driving the air cylinder 51 such that, the rod 76 and the stopper 65 make a contact, the head bar 10 is positioned at the retracted position. Note that, in the description below, a direction in which the rotator 70 rotates in a direction of assuming a state of the rod 75 facing the stopper 65 from the state of the rod 76 facing the stopper 65 is referred to as a forward direction, and a direction in which the rotator 70 rotates in a direction of assuming a state of the rod 72 facing the stopper 65 from a state of the rod 76 facing the stopper 65 is referred to as a backward direction (refer to FIG. 9A and FIG. 9B).

Next, a method for adjusting a position in the vertical direction of the head bar 10 using the adjuster 60 will be described below by citing a case of moving the head bar 10 at the retracted position to the second print position as an example.

Figure 9A:
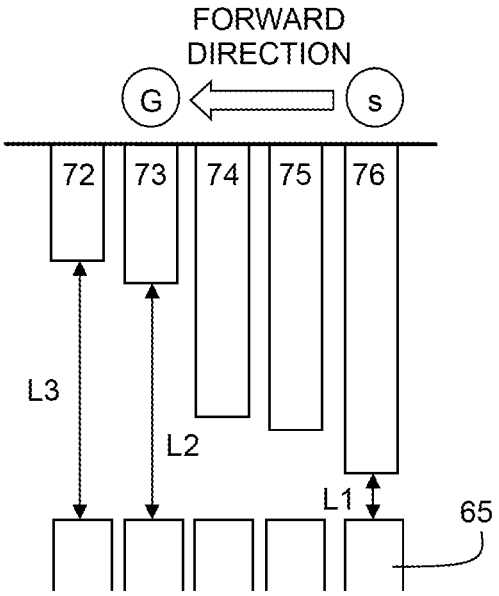
FIG. 9A is an illustration diagram for describing a case of moving the head bar 10 at a retracted position to a second print position.
Figure 9B:
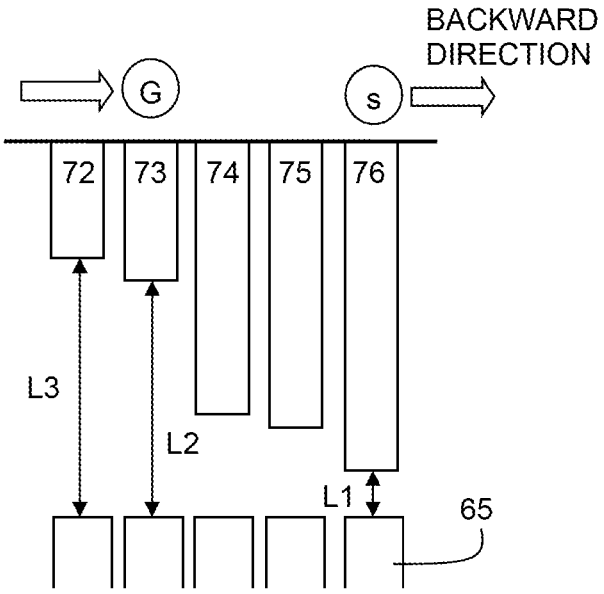
FIG. 9B is an illustration diagram for describing a case of moving the head bar 10 at the second print position to the retracted position.

Firstly, the controller 7, by driving the air cylinder 51, moves the first frame 42 upward such that, the first frame 42 is farthest from the second frame 43. At this time, as depicted in FIG. 9A and FIG. 9B, a distance in the vertical direction between the rod 76 and the stopper 65 is L1, a distance in the vertical direction between the rod 73 and the stopper 65 is L2, and a distance in the vertical direction between the rod 72 and the stopper 65 is L3 (L1<L2<L3).

Next, the controller 7 rotates the rotator 70 by driving the motor 62 such that a state changes from a state in which the rod 76 and the stopper 65 are facing (face-to-face) in the vertical direction to a state in which the rod 73 and the stopper 65 are facing in the vertical direction. In this case, the following two methods may be considered. Firstly, rotating the rotator 70 in the forward direction such that, the stopper 65, after facing the rod 75 and the rod 74, faces the rod 73, may be considered (refer to FIG. 9A). Secondly, rotating the rotator 70 in the backward direction such that, the stopper 65, after facing the rod 72, faces the rod 73 may be considered (refer to FIG. 9B). From a viewpoint of a drive amount of the motor 62, or in other words, as to how substantially (largely) the rotator 70 is to be driven, rotating the rotator 70 in the backward direction as in the latter case is more effective than rotating the rotator 70 in the forward direction. However, when the rotator 70 is driven in such backward direction, the rod 72 which is at the distance L3 from the stopper 65 is to face the stopper 65 before the rod 73 which is at the distance L2 from the stopper 65 faces the stopper 65. In case, when a trouble such as air of the air cylinder 51 is vented occurs while the rod 72 and the stopper 65 are facing each other, the air cylinder 51 is not capable of supporting the first frame 42, and there is a possibility that the first frame 42 and the head bar 10 descend. In this case, since there is a possibility that the head bar 10 descends further beyond the second print position that had been planned initially, there is a possibility of making a contact with the recording paper M and damaging (scratching) the lower surface of the head bar 10 according to a thickness of the recording medium M. Moreover, in a case in which the first frame 42 and the head bar 10 have descended due to the air of the air cylinder 51 being vented, the larger an amount of descent (in other words, the distance between the rod and the stopper), the larger is a magnitude of an impact due to a collision of the rod and the stopper.

Therefore, in the present disclosure, in order that there is no possibility of the head bar 10 descending beyond the second print position as planned initially, and moreover, for reducing the magnitude of the impact received in a case in which the first frame 42 and the head bar 10 have descended where a certain rod and stopper make a contact, the rotator 70 is rotated in the forward direction which is a direction in which the stopper 65, after facing the rod 75 and the rod 74, comes face-to-face with the rod 73. Therefore, supposedly, even in a case in which the trouble such as, air in the air cylinder is vented when the stop 65 is facing the rod 75 or the rod 74 occurs, there is no possibility that the head bar 10 descends beyond the second print position that had been planned initially. Moreover, the magnitude of impact in a case in which the first frame 42 and the head 10 descended when the rod 75 (74) and the stopper 65 are facing each other becomes smaller as compared to the magnitude of impact in a case in which the first frame 42 and the head bar 10 descended when the rod 72 and the stopper 65 are facing each other. Accordingly, it is possible to control a damage of the head bar 10 due to descent beyond the second print position and a damage of the head bar 10 (for example, a damage of the lower surface of the head bar 10) caused by the impact due to collision of the rod and the stopper.

Due to a similar reason, in a case of moving the head bar 10 at the second print position, to the retracted position, the rotator 70 is to be rotated in the forward direction which is a direction of facing the rod 76, after the stopper has faced the rod 74 and the rod 75. Accordingly, since it is possible to prevent the rod 72 which is at the distance L3 (L3>L2) from the stopper 65, from facing the stopper 65, there is no possibility that the bead bar 10 descends beyond the second print position that has been planned initially. Accordingly, it is possible to suppress the damage of head bar 10, such as the lower surface of the head bar 10 from being damaged. Moreover, as mentioned above, it is possible to suppress the impact due to the collision of the rod and the stopper.

To sum up, in the present disclosure, in a case of rotating the rotator 70 such that the state changes from the state in which the stopper 65 is facing one (rod at a start position) of the rods 72 to 76 to the state in which the stopper 65 is facing another rod (rod at a stop position) of the rods 72 to 76, the rotator 70 is to be rotated such that the stopper 65 does not face a rod shorter than the rod at the start position and the rod at the stop position. Accordingly, there is no possibility of the head bar 10 descending below an anticipated position, and it is possible to suppress the damage of the head bar 10 caused due to the descent of the head bar 10, such as a damage of the lower surface of the head bar 10. Moreover, as mentioned above, it is possible to suppress the impact due to the collision of the rod and the stopper.

Next, another aspect of the rotator will be described below. In the description above, lengths of the rods 72 to 76 were mutually different. In the present disclosure, the rotator 70 is not restricted to the aspect mentioned above. For instance, it is possible to adopt a rotator 170 as depicted in FIG. 10A and FIG. 10B.

Figure 10A:
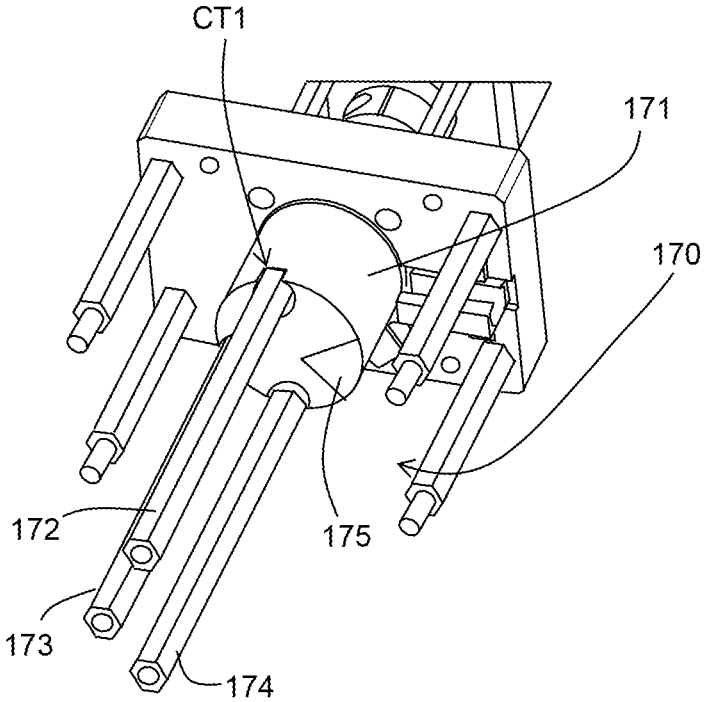
FIG. 10A is a perspective view for describing a rotator 170.
Figure 10B:
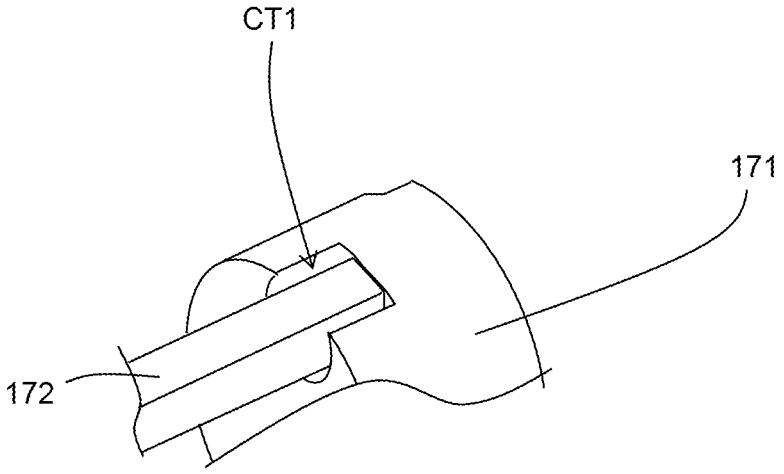
FIG. 10B is a partially enlarged view of FIG. 10A.

As depicted in FIG. 10A and FIG. 10B, the rotator 170 includes a base 171 which has a circular cylindrical shape, and three rods 172, 173, and 174 (hereinafter, 'rods 172 to 174') provided to a lower surface of the base 171. The rods 172 to 174 are formed of stainless steel similarly as the rods 72 to 76. The three rods 172 to 174 are hexagonal column-shaped members having mutually same length. As depicted in FIG. 10A, a recess is formed at a lower end of the rods 172 to 174 (a contact surface which comes in contact with the stopper 65). Accordingly, projections to be fitted in the recesses in the contact surface of the rods 172 to 174 are formed on the upper surface of the stopper 65. Note that, a thickness of the base 171 is larger than a thickness of the base 71 as is evident from comparison with the base 71 depicted in FIG. 8A and FIG. 8B. A recess 175 (corresponds to the second contact portion of the present disclosure) having a sectorial shape is formed on a lower surface of the base 171, and a height-wise position of the recess 175 is same as a height-wise position of the contact portion of the rod 72 of the rotator 70. Therefore, by bringing the stopper 65 in contact with the recess 175 of the base 171, it is possible to position the head bar 10 at the first print position.

A height-wise position of a portion of the lower surface of the base 171 in which the recess 175 having a sectorial shape is not formed, is same as a height-wise position of the contact portion of the rod 73 of the rotator 70. Therefore, by bringing the stopper 65 in contact with a portion of the base 171 on which the recess 175 is not formed, it is possible to position the head bar 10 at the second print position.

A cut CT1 is made in a portion of the lower surface of the base 171, in contact with the rod 172. A depth of the cut CT1 is adjusted such that a height-wise position of the rod 172 becomes same as a height-wise position of a contact portion of the rod 74 of the rotator 70. Therefore, by bringing the stopper 65 in contact with the contact portion of the rod 172, it is possible to position the head bar 10 at the capping position. Moreover, a cut shallower than the cut CT2 is made in a portion of the lower surface of the base 171, in contact with an end portion of the rod 173. A depth of the cut is adjusted such that a height-wise position of a front end of the rod 173 becomes same as a height-wise position of a front end of the rod 75 of the rotator 70. Therefore, by bringing the stopper 65 in contact with the front end of the rod 173, it is possible to position the head bar 10 at the wiping position. Furthermore, no cut is made in a portion of the lower surface of the base 171, in contact with an end portion of the rod 174. A height-wise position of a front end of the rod 174 is same as a height-wise position of a front end of the rod 76 of the rotator 70. Therefore, by bringing the stopper 65 in contact with the front end of the rod 174, it is possible to position the head bar 10 at the retracted position.

Advantageous Effects of the Embodiment

In the printing apparatus 1 according to the present embodiment, the head bar unit includes at least one head bar 10, the movement 50, and the adjuster 60. As mentioned above, the head bar unit further includes the pair of arms 41, the first frame 42 in the form of a plate to which the pair of arms 41 is attached, the second frame 43 which is provided at the lower side of the first frame 42, and the two shafts 44. The rotator 70 (the rotator 170) and the motor 62 of the adjuster 60 are supported by the first frame 42 via the trestle 61, and the stopper 65 is supported by the second frame 43.

In the configuration mentioned above, the movement 50 is configured to move in the vertical direction the head bar 10 and the adjuster 60. The motor 62 provided to the adjuster 60 is not provided to the movement 50 which is for moving the head bar 10 and the adjuster 60 in the vertical direction, but is provided for rotating the rotator 70 (the rotator 170). Therefore, it is possible to adopt a motor having a small output as compared to a case of providing a motor to the movement 50, and it is possible to use a motor of an inexpensive price. Moreover, the adjuster 60 which adjusts the position in the vertical direction of the head bar 10 being provided apart from the movement 50, the movement is not required to carry out a fine position control. Therefore, in the movement 50, there is no need to use a motor, and it is possible to adopt a mechanism such as the air cylinder 51, which, though unsuitable for fine position control, is cheaper than using a motor.

The rotator 70 includes the base 71, and the rods 72 to 76 extended from the base 71. The lower end of the rods 72 to 76 makes a contact with the upper end of the stopper 65. The rotator 170 includes the base 171, and the rods 172 to 174 extended from the base 171. The lower end of the rods 172 to 174 makes a contact with the upper end of the stopper 65. In the present disclosure, it is also possible to fabricate the rotator by machining as an integrated component from one member. Whereas, in the present embodiment, the rotator 70 described above has a structure in which the rods 72 to 76 are fixed to the base 71, and the rotator 170 has a structure in which the rods 172 to 174 are fixed to the base 171. In this case, it is possible to fabricate the rotator 70 (the rotator 170) by machining easily as compared to a case of fabricating the rotator 70 (rotator 170), as an integrated component from one member.

The recess 175 is formed on the lower surface of the base 171 of the rotator 170. In the vertical direction, a distance between the recess 175 and the upper surface of the stopper 65 is longer than a distance between the lower end of the rods 172 to 174 and the upper surface of the stopper 65. It is possible to make a tolerance for the depth of the recess 175 in a case of forming the recess 175 smaller than a tolerance for lengths of the rods 172 to 174 in a case of forming the rods 172 to 174. In other words, it is possible to carry out accurately the positioning of the head bar 10 when the upper surface of the stopper 65 is brought in contact with the recess 175 than having brought in contact with the lower end of the rods 172 to 174.

In the embodiment described above, the rotator 70 includes the rods 72 to 76 extended from the base 71, and the positions of the contact portions of the rods 72 to 76 in the vertical direction differ mutually. Similarly, the rotator 170 includes the rods 172 to 174 extended from the base 171, and the positions of the contact portions of the rods 172 to 174 in the vertical direction differ mutually. In such manner, the positions of the contact portions of the plurality of rods being mutually different, it is possible to carry out easily the positioning at the plurality of positions by using one rotator.

In the embodiment described above, the cut CT1 is made in the portion of the lower surface of the base 171, in contact with the rod 172. Whereas, the cut shallower than the cut CT1 is made in the portion of the lower surface of the base 171, in contact with the rod 173. In such manner, the cuts of different depths being made in the respective portions of the lower surface of the base 171, in contact with the rods 172 and 173, the positions in the vertical direction of the portions of the lower surface of the base 171, in contact with the rods 172 and 173 differ mutually. Therefore, even in a case in which rods of the same length are used as the rods 172 and 173, the positions in the vertical direction of the front ends (contact portions) of the rods 172 and 173 become different positions. Therefore, it is possible to use general-purpose products having a same size as the rods 172 and 173, and to reduce a cost.

In the embodiment described above, the rods 72 to 76 are formed of stainless steel, and the stopper 65 is formed of hardened stainless steel. Therefore, the hardness of the stopper 65 is higher than the hardness of the rods 72 to 76. Accordingly, it is possible to suppress the stopper from being damaged by making a contact with the rod.

In the embodiment described above, the heads 11 are arranged side-by-side in the head bar 10, in a row in the left-right direction intersecting the vertical direction. Moreover, the adjuster 60 is arranged almost in the middle of the head bar 10. Furthermore, the pair of air cylinders 51 is fixed to the first frame 42 and the second frame 43 at positions away at an equal distance in the left-right direction from the adjuster 60. Thus, since the movement 50 moves the head bar 10 supporting at least at two points, there is no possibility of the head bar 10 getting tilted (inclined), thereby making it possible to support the head bar 10 in a balanced manner. Moreover, the adjuster 60 being arranged almost in the middle of the head bar 10 in the left-right direction, there is no possibility of the head bar 10 getting tilted even when the adjuster 60 adjusts the vertical position of the head bar 10. Note that, the adjuster 60 is not restricted to be arranged accurately (exactly) in the middle in the left-right direction of the head bar, but preferably, is to be arranged in the middle as far as possible. Moreover, it is preferable that, at a position where the adjuster 60 is arranged, a load on the left side and the right side of the head bar 10 is same.

In the embodiment described above, the recess is formed on the contact surface of the rods 172 to 174, and the projection that fits in the recess of the contact surface of the rods 172 to 174 is formed on the upper surface of the stopper 65. Accordingly, it is possible to bring the rod and the stopper in contact assuredly. Note that, a projection may be formed on the contact surface of the rods 172 to 174, and a recess in which the projection on the contact surface of the rods 172 to 174 fits may have been formed on the upper surface of the stopper 65.

In the embodiment disclosed this time, all the points are exemplifications, and not restricted. For each configuration indicated in the embodiment described above, not all components are essential, and the configuration can be omitted partly according to the requirement. For example, the number and the arrangement of head bars 10 and the number and the arrangement of heads in one head bar may be changed appropriately. Moreover, the number and positions of nozzles 11*a* in each head 11 may be changed appropriately. Furthermore, in the embodiment described above, one movement 50 and one adjuster 60 were provided to one head bar 10, but the present disclosure is not restricted to such aspect. For instance, one movement 50 and adjuster 60 may have been provided to the plurality of head bars 10. Moreover, one movement 50 and adjuster 60 may have been provided to two head bars 10. Furthermore, in the embodiment described above, the controller 7 was provided to the printing apparatus 1, but the present disclosure is not restricted to such aspect. For instance, the controller 7 may have been provided to the head bar unit.

In the embodiment described above, the structure, the shape, and the material of the movement 50 and the adjuster 60 may be changed appropriately. For instance, in the embodiment described above, the rotator of the adjuster included five or three rods, and had five contact portions including the contact portion formed on the base of the rotator. However, the present disclosure, is not restricted to such aspect, and the rotator may have not more than four or not less than six contact portions. Moreover, in the embodiment described above, the rods of the rotator were formed of stainless steel, and the stopper was formed of hardened stainless steel. However, the present disclosure is not restricted to such aspect. It is possible to form the rods and the stopper of appropriate materials. However, it is preferable that the hardness of the stopper is more than the hardness of the rod.

Moreover, the present disclosure is not restricted to a printing apparatus of an ink-jet type which jets an ink. The present teaching may be applicable even to a printing apparatus which is used for various applications other than printing of an image. For instance, it is possible to apply the present teaching even to a printing apparatus which forms an electroconductive pattern on a substrate surface by jetting an electroconductive liquid on to the substrate. It is intended that the scope of the present disclosure includes all modifications within the scope of the patent claims and a scope equivalent to the scope of the patent claims. In the present teaching, the ordinal numbers indicate a name, and do not necessarily indicate the order.

What is claimed is:

1. A head bar unit comprising:

a head bar including a plurality of heads;

an adjuster configured to adjust positions in a vertical direction of the plurality of heads; and a movement configured to move the head bar and the adjuster in the vertical direction, wherein the adjuster includes:

a motor;

a rotator including a plurality of contact portions, positions of the contact portions in the vertical direction being different from each other, and the rotator being configured to be rotated by the motor around a rotating shaft which is parallel to the vertical direction; and a stopper located at a position facing the rotator in the vertical direction, and configured to position the rotator in the vertical direction, by making a contact with one of the contact portions.

2. The head bar unit according to claim 1, wherein the rotator includes:

a base; and a first rod extended in the vertical direction from the base, the first rod including a near-end and a farther-end that is farther from the stopper than the near-end; and wherein a first contact portion, that is one of the plurality of contact portions, is located at the near-end of the first rod.

3. The head bar unit according to claim 2, wherein a second contact portion, that is one of the plurality of contact portions, is located at the base, and a distance in the vertical direction between the second contact portion of the base and the stopper is longer than a distance in the vertical direction between the first contact portion of the first rod and the stopper.

4. A head bar system comprising:

the head bar unit according to claim 3; and a maintenance unit configured to perform a maintenance processing for maintaining a condition of a nozzle surface of each of the plurality of heads, wherein in a case that the stopper makes contact with the second contact portion of the base, the nozzle surface overlaps with the maintenance unit in the vertical direction, and wherein in a case that the stopper makes contact with the first contact portion of the first rod, the nozzle surface is separated from the maintenance unit in the vertical direction.

5. A printing apparatus comprising:

the head bar system according to claim 4; and a conveyor configured to convey a sheet toward a head bar unit in the head bar system.

6. The head bar unit according to claim 2, wherein the rotator further includes a second rod extended in the vertical direction from the base, the second rod including a near-end and a farther-end that is farther from the stopper than the near-end, wherein a third contact portion, that is one of the plurality of contact portions, is located at the near-end of the second rod, and wherein a position in the vertical direction of the first contact portion of the first rod is different from a position in the vertical direction of the third contact portion of the second rod.

7. The head bar unit according to claim 6, wherein the base includes:

a first portion with which the farther-end of the first rod makes a contact, and a second portion with which the farther-end of the second rod makes a contact, and of which a position in the vertical direction differs from a position in the vertical direction of the first portion, and wherein a length in the vertical direction of the first rod is same as a length in the vertical direction of the second rod.

8. A head bar system comprising:

the head bar unit according to claim 6; and a maintenance unit configured to perform a maintenance processing for maintaining a condition of a nozzle surface of each of the plurality of heads, wherein the maintenance unit includes a cap configured to cover the nozzle surface and a wiper configured to wipe the nozzle surface, wherein in a case that the movement is driven so that the rotator and the stopper are spaced apart to be farthest in the vertical direction, a distance in the vertical direction between the first contact portion of the first rod and the stopper is longer than a distance in the vertical direction between the third contact portion of the second rod and the stopper, wherein in a case that the first contact portion of the first rod makes contact with the stopper, the nozzle surface makes contact with the cap, and wherein in a case that the third contact portion of the second rod makes contact with the stopper, the nozzle surface makes contact with the wiper.

9. A printing apparatus comprising:

the head bar unit according to claim 1; and a conveyor configured to convey a sheet toward the head bar unit.

10. The head bar unit according to claim 1, wherein a hardness of the stopper is higher than a hardness of the plurality of contact portions on the rotator.

11. The head bar unit according to claim 1, wherein the plurality of heads is aligned side-by-side along a direction of intersection intersecting the vertical direction, wherein the movement supports the head bar at least at two distant points in the direction of intersection, and wherein the stopper is positioned in the middle of the two points in the direction of intersection.

12. The head bar unit according to claim 1, wherein a recess is formed in each of the plurality of contact portions, and wherein a projection which fits in the recess of the plurality of contact portions is formed on a portion, of the stopper, wherein the portion of the stopper makes contact with the contact portion.

13. The head bar unit according to claim 1, further comprising:

a controller configured to control the motor, wherein the plurality of contact portions of the rotator includes a far contact portion, a middle contact portion and a near contact portion, wherein in a case that the movement is driven such that the rotator and the stopper are spaced apart to be farthest in the vertical direction, a distance in the vertical direction between the stopper and the far contact portion becomes L1, a distance in the vertical direction between the stopper and the middle contact portion becomes L2, and a distance in the vertical direction between the stopper and the near contact portion becomes L3 (L1>L2>L3) respectively, wherein in a case of changing a state from a state in which, the stopper makes contact with the middle contact portion, to a state in which the stopper makes contact with the near contact portion, the controller is configured to:

separate the stopper from the middle contact portion in the vertical direction, by driving the movement;

make the stopper to face the near contact portion by rotating the rotator by driving the motor so that the stopper does not face the far contact portion; and make the stopper to make contact with the near contact portion by driving the movement.

14. The head bar unit according to claim 13, wherein in a case of changing a state from a state in which, the stopper makes contact with the near contact portion, to a state in which the stopper makes contact with the middle contact portion, the controller is configured to:

separate the stopper from the near contact portion in the vertical direction by driving the movement;

make the stopper to face the middle contact portion by rotating the rotator by driving the motor so that, the stopper does not face the far contact portion; and make the stopper to make contact with the middle contact portion, by driving the movement.

15. A printing apparatus comprising:

the head bar unit according to claim 1; and a controller configured to control the motor, wherein the plurality of contact portions of the rotator includes a far contact portion, a middle contact portion and a near contact portion, wherein in a case that the movement is driven such that the rotator and the stopper are spaced apart to be farthest in the vertical direction, a distance in the vertical direction between the stopper and the far contact portion becomes L1, a distance in the vertical direction between the stopper and the middle contact portion becomes L2, and a distance in the vertical direction between the stopper and the near contact portion becomes L3 (L1>L2>L3) respectively, wherein in a case of changing a state from a state in which the stopper makes contact with the middle contact portion, to a state in which the stopper makes contact with the near contact portion, the controller is configured to:

separate the stopper from the middle contact portion in the vertical direction, by driving the movement;

make the stopper to face the near contact portion by rotating the rotator by driving the motor so that, the stopper does not face the far contact portion; and make the stopper to make contact with the near contact portion by driving the movement.

16. The printing apparatus according to claim 15, wherein in a case of changing the state from a state in which, the stopper makes contact with the near contact portion, to a state in which the stopper makes contact with the middle contact portion, the controller is configured to:

separate the stopper from the near contact portion in the vertical direction by driving the movement;

make the stopper to face the middle contact portion by rotating the rotator by driving the motor so that, the stopper does not face the far contact portion; and make the stopper to make contact with the middle contact portion, by driving the movement.

* * * * *